US006439327B1

(12) United States Patent
Griffin et al.

(10) Patent No.: US 6,439,327 B1
(45) Date of Patent: Aug. 27, 2002

(54) CUTTING ELEMENTS FOR ROTARY DRILL BITS

(75) Inventors: Nigel Dennis Griffin, Whitminster; Terry R. Matthias, Upton St. Leonards, both of (GB)

(73) Assignee: Camco International (UK) Limited (GB)

( * ) Notice: Subject to any disclaimer, the term of this patent is extended or adjusted under 35 U.S.C. 154(b) by 146 days.

(21) Appl. No.: 09/645,650

(22) Filed: Aug. 24, 2000

(51) Int. Cl.[7] ..... E21B 10/46
(52) U.S. Cl. ..... 175/434; 175/433; 51/295
(58) Field of Search ..... 175/433, 428, 175/434; 51/293, 295, 297

(56) References Cited

U.S. PATENT DOCUMENTS

| | | | | |
|---|---|---|---|---|
| 3,743,489 A | | 7/1973 | Wentorf, Jr. et al. | |
| 3,767,371 A | | 10/1973 | Wentorf, Jr. et al. | |
| 4,108,614 A | | 8/1978 | Mitchell | |
| 4,156,329 A | | 5/1979 | Daniels et al. | |
| 4,255,165 A | | 3/1981 | Dennis et al. | |
| 4,478,298 A | | 10/1984 | Hake et al. | |
| 4,498,549 A | | 2/1985 | Jürgens | |
| 4,525,179 A | | 6/1985 | Gigl | |
| 4,539,018 A | * | 9/1985 | Whanger et al. | 51/295 |
| 4,605,343 A | * | 8/1986 | Hibbs et al. | 125/39 |
| 4,689,919 A | | 9/1987 | Kawakita et al. | |
| 4,726,718 A | | 2/1988 | Meskin et al. | |
| 4,871,377 A | | 10/1989 | Frushour | |
| 4,943,488 A | | 7/1990 | Sung et al. | |
| 5,011,509 A | * | 4/1991 | Frushour | 51/293 |
| 5,049,164 A | | 9/1991 | Horton et al. | |
| 5,116,568 A | * | 5/1992 | Sung et al. | 419/11 |
| 5,135,061 A | | 8/1992 | Newton, Jr. | |
| 5,159,857 A | | 11/1992 | Jurewicz | |
| 5,199,832 A | | 4/1993 | Meskin et al. | |
| 5,205,684 A | | 4/1993 | Meskin et al. | |
| 5,217,081 A | | 6/1993 | Waldenström et al. | |
| 5,492,188 A | | 2/1996 | Smith et al. | |
| 5,496,638 A | | 3/1996 | Waldenström et al. | |
| 5,498,480 A | * | 3/1996 | Tank et al. | 428/212 |
| 5,833,021 A | | 11/1998 | Mensa-Wilmot et al. | |
| 5,944,129 A | | 8/1999 | Jensen | |
| 6,106,957 A | * | 8/2000 | Fang | 428/545 |
| 6,187,068 B1 | * | 2/2001 | Frushour et al. | 407/118 |
| 6,248,447 B1 | * | 6/2001 | Griffin et al. | 175/434 |

FOREIGN PATENT DOCUMENTS

EP 0 546 725 B1 9/1996

OTHER PUBLICATIONS

European Search Report, Summary Page for EP 01 30 4878; filing date Jun. 4, 2001.

* cited by examiner

*Primary Examiner*—Hoang Dang
(74) *Attorney, Agent, or Firm*—Jeffery E. Daly

(57) ABSTRACT

A preform cutting element, for a rotary drill bit, and a rotary drill bit with prefrom cutting elements including a facing table of superhard material having a front face, a rear surface is bonded to the front surface of a substrate which is less hard than the superhard material and has a rim or edge section of the superhard material at least partially covered by a metallic material different from the substrate material. The metallic material is bonded to the edge section of the superhard material through a high pressure bonding step. The superhard material covered by the compliant metallic material is protected from impact forces occurring in drill bit operations such as tripping.

23 Claims, 4 Drawing Sheets

CUTTING ELEMENTS FOR ROTARY DRILL BITS

BACKGROUND OF THE INVENTION

1. Field of the Invention

The invention relates to cutting elements for rotary drill bits, and of the kind comprising a facing table of superhard material having a front face and a rear surface bonded to the front surface of a substrate which is less hard than the superhard material and rim material coating the edges of the facing table.

2. Description of the Related Art

Such cutting elements usually have a facing table of polycrystalline diamond, although other superhard materials are available, such as cubic boron nitride. The substrate of less hard material is often formed from cemented tungsten carbide, and the facing table and substrate are bonded together during formation of the element in a high pressure, high temperature forming press. This forming process is well known.

Each preform cutting element may be mounted on a carrier in the form of a generally cylindrical stud or post received in a pocket in the body of the drill bit. The carrier is often also formed from cemented tungsten carbide, the surface of the substrate being brazed to a surface on the carrier. Alternatively, the substrate itself may be of sufficient thickness as to provide, in effect, a cylindrical stud which is sufficiently long to be directly received in a pocket in the bit body, without being first brazed to a carrier. As is well known, the body of the drill bit itself may be machined from metal, usually steel, or may be molded using a powder metallurgy process.

Cutting elements of the above-described kind are often in the form of circular or part-circular tablets. Each cutter is so mounted on the bit body that a portion of its periphery defines a cutting edge which acts on the surface of the formation being drilled. In the case of a circular cutter the cutting edge will be provided by a curved stretch of the circular periphery of the cutter. In some locations on the drill bit, such as in the gauge region of the bit, however, the cutting element will be formed with a straight cutting edge across part of its periphery to act on the formation.

Such cutting elements are subjected to extremes of temperature and heavy loads, including impact loads, when the drill is in use down a borehole. It is found that under drilling conditions spalling of the diamond table can occur, that is to say the separation and loss of diamond material over the cutting surface of the table. Such spalling usually spreads from the cutting edge, probably as a result of impact forces. The spalling reduces the cutting efficiency of the element, and in severe cases can lead to delamination, that is to say separation of the diamond table from the substrate.

In order to increase the lifetime or wear-resistance of superhard cutter elements it has been suggested to coat the superhard layer with layers of softer material. In U.S. Pat. No. 5,049,164 for example, a cutter element is described having a multi-layer metal coating. Further disclosure of coated cutter elements can be found in U.S. Pat. Nos. 5,135,061, and 5,833,021.

The known coating layers are usually applied to prefabricated cutting elements using plating techniques, vapor deposition techniques, sputtering, vacuum deposition, arc processes or high velocity spray processes. It is therefore seen as an object of the present invention to provide cutter elements where the facing table of superhard material is at least partially coated with a softer material. More specifically it is seen as an object of the invention to provide such cutter elements without additional coating step in the production process of the cutters.

SUMMARY OF THE INVENTION

According to the invention there is provided a preform cutting element, for a rotary drill bit, including a facing table of superhard material having a front face and a rear surface bonded to the front surface of a substrate which is less hard than the superhard material, the facing table having edges between the front face and the rear face, the edges being at least partially coated with a layer made of material less hard than the superhard material but different from the substrate material, and being high pressure bonded to the edges.

According to another aspect of the invention there is provided a drill bit comprising a body and a plurality of cutter elements as described above.

In a preferred embodiment a cutter element in accordance with the present invention has a uniform outer diameter prior to mounting the cutter element in the drill bit with edges of the facing table being at least partially coated with the coating material. In a variant of this embodiment the edges of facing table are essentially completely covered with the coating material.

In yet another preferred embodiment the coating material is bonded to both the superhard facing table and the substrate.

As defined herein, high-pressure bonding means a joining of two materials by applying high pressure and high temperature to the interface between the two materials. This process is known as such and widely used in the industry. In fact it is seen as very advantageous to provide the coating during the same high pressure and high temperature step that establishes the bond between the facing table and the substrate.

The materials for the coating layer are preferably chosen to be softer than the substrate material. Preferred materials for the coating layer are bondable to diamond and must be able to withstand the temperature and pressure to which it is subjected in the press during the diamond synthesis. Suitable coating material may be molybdenum (Mo), tantalum (Ta), niobium (Nb) and metallic alloys thereof.

Preferred material for the substrate are tungsten carbide or carbides of one of the group IVB, VB, or VIB metals of the periodic table, or alloys thereof, or other suitable materials and may contain a suitable binder material such as cobalt, nickel, or iron.

The superhard material is synthetic or natural diamond, cubic boron nitride or wurtzite boron nitride, and may contain binder material as described above.

The invention provides cutting elements that have a rim or annular jacket of soft compliant metal surrounding the superhard material. The compliance affords protection to the cutter element during insertion into the drill bit body and use thereof. Compared to previous alternatives, the rim material can be applied with only minor modification of the existing production methods for basic cutting elements. No extra step of plating or deposition is required.

BRIEF DESCRIPTION OF THE DRAWINGS

The following is a more detailed description of embodiments of the invention, by way of example, reference being made to the accompanying drawings in which.

DETAILED DESCRIPTION OF THE PREFERRED EMBODIMENTS

Figure 1:
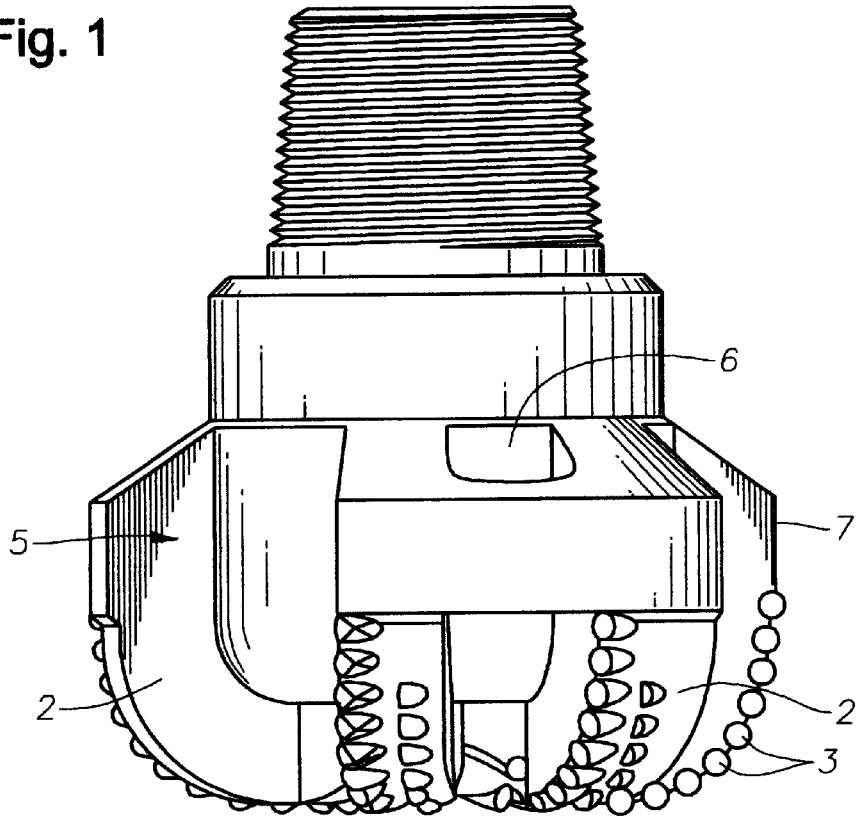
FIG. 1 is a diagrammatic side elevation of one form of rotary drag-type drill bit of a kind with which the preform cutting elements of the present invention may be used.
Figure 2:
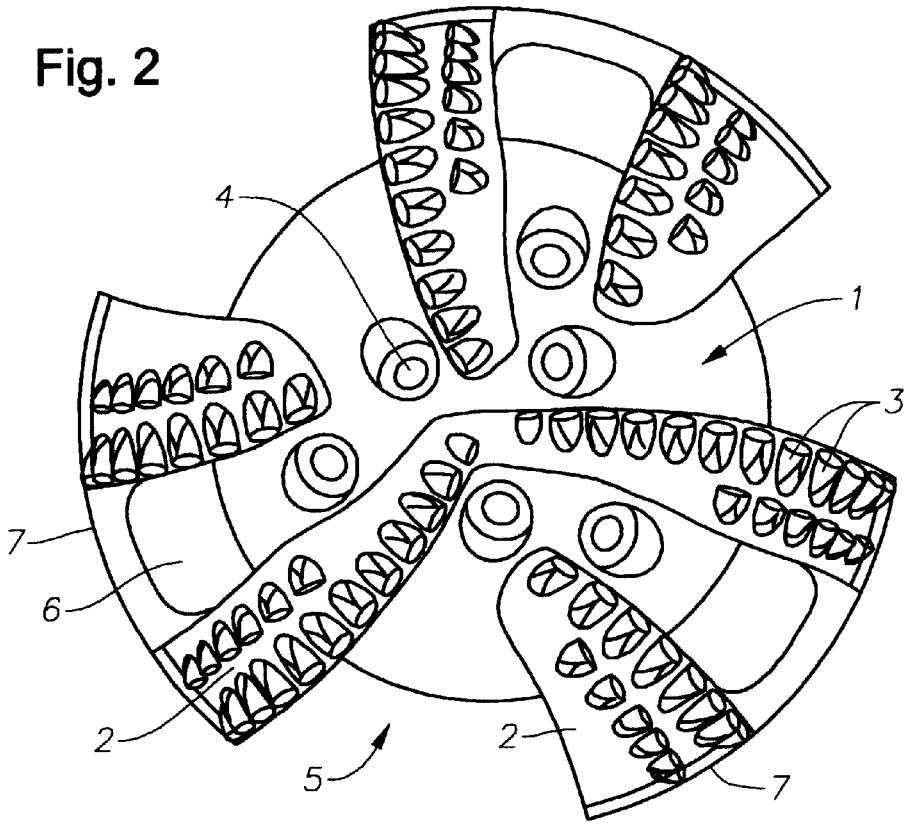
FIG. 2 is an end view of the bit shown in FIG. 1.

One typical and well known form of rotary drag-type drill bit is shown in FIGS. 1 and 2 and is known generically as a fixed cutter rotary drill bit. The drill bit comprises a bit body 1 on the leading surface of which are formed six circumferentially spaced upstanding blades 2 which extend outwardly away from the axis of rotation of the bit. A number of preform cutting elements 3 are spaced apart side-by-side along each blade 2 of the bit body 1. As previously mentioned, each cutting element may be brazed to a carrier which is secured within a pocket in the blade 2, or the substrate of the cutting elements may be of sufficient length to be received directly in the pocket. The preform cutting elements 3 are arranged in a generally spiral configuration over the leading face of the drill bit so as to form a cutting profile which sweeps across the whole of the bottom of the borehole being drilled as the bit rotates.

In FIGS. 1 and 2 all of the preform cutting elements 3 on the body 1 of the drill bit are shown as being "pointed" cutters, each being formed with a cutting apex defined between two adjacent regions of the peripheral surface which are disposed at an angle to one another. However, it will be appreciated that it is not essential, according to the present invention, for all of the preform cutting elements on the drill bit to be of this type and some of the cutting elements may be of other shapes, for example they may be circular or part-circular cutting elements, particularly in the gauge region of the drill bit.

The bit body is formed with a central passage (not shown) which communicates through subsidiary passages with nozzles 4 mounted in the leading surface of the bit body. Drilling fluid under pressure is delivered to the nozzles through the internal passages and flows outwardly through the spaces between adjacent blades for cooling and cleaning the cutters.

The spaces between the blades 2 lead to peripheral junk slots 5, or to internal passages 6 in the bit body, through which the drilling fluid flows upwardly to the annulus between the drill string and the surrounding formation, passing upwardly through the annulus to the surface. The junk slots 5 are separated by gauge pads 7 which bear against the side wall of the borehole and are formed with bearing or abrasion inserts (not shown).

The bit body and blades may be machined from metal, usually steel, which may be hardfaced. Alternatively the bit body, or a part thereof, may be molded from matrix material using a powder metallurgy process. The general construction of such drill bits, and their methods of manufacture, are well known in the art and will not be described in further detail.

Figure 10:
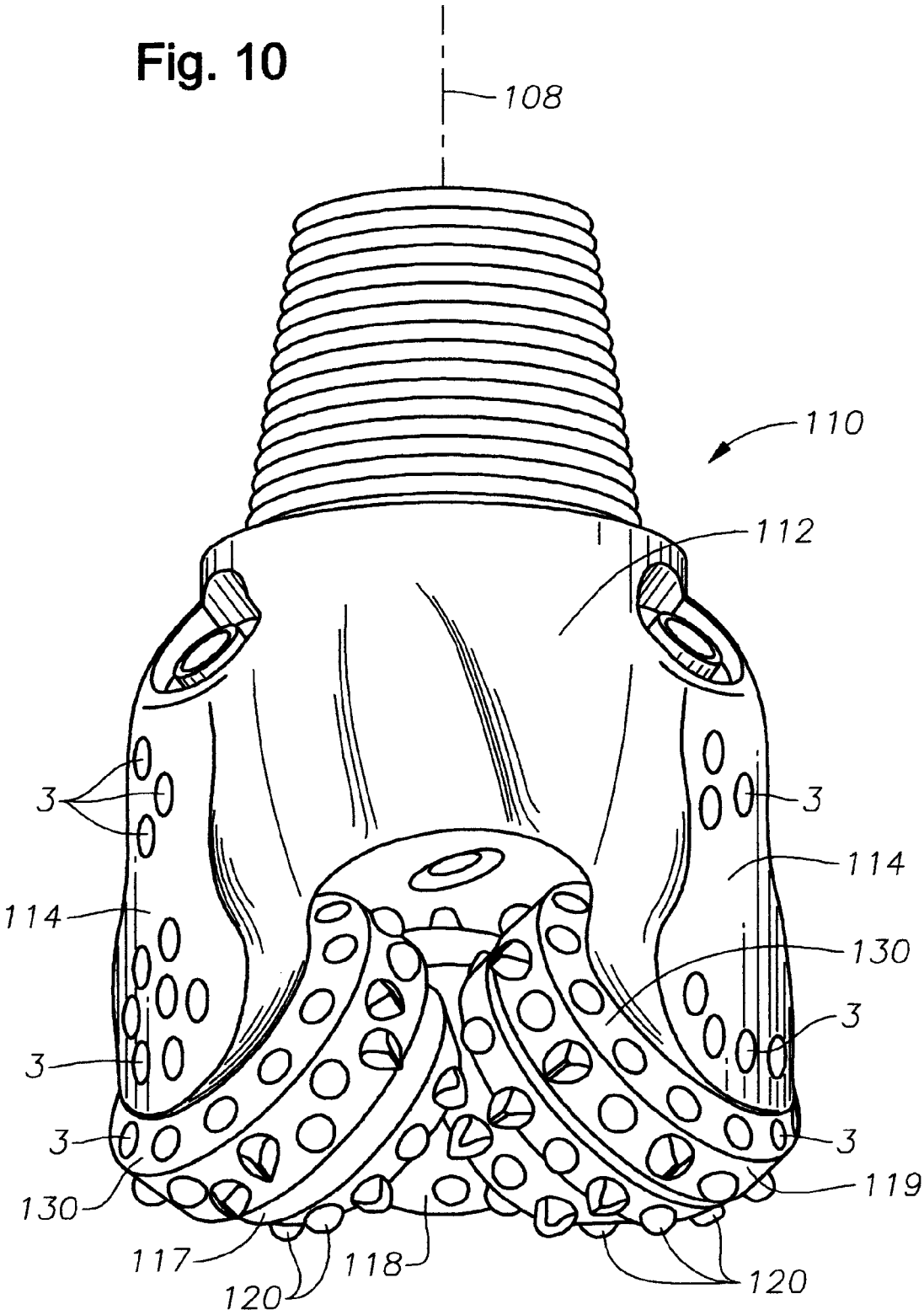
FIG. 10 shows a perspective view of a rolling cutter drill bit.

Another form of rotary drill bit is shown in FIG. 10. A rolling cutter drill bit 110 includes a bit body 112 comprising a plurality of extending legs 114 and rolling cone cutters 117, 118, and 119. A typical rolling cone cutter 118 is rotatably mounted upon one of extending legs 114. Attached to the rolling cone cutters 117, 118, 119 are cutting inserts 120, which in operation engage the earth while the bit 110 is rotated about its longitudinal axis 108. The rotation of the bit 110 and the engagement with the earth causes rotation of the rolling cone cutters 117, 118, 119 to effect a drilling action.

Preform cutting elements 3 are shown mounted in the legs 114 of the bit body 112 to minimize wear of the leg while the rolling cutter drill bit 110 is drilling through the earth. In addition, preform cutting elements 3 may be utilized on the rolling cone cutters 117, 118, and 119 on the gauge reaming rows 130 to help the bit 110 continue to drill a full gauge borehole in the earth. The general construction of such rolling cutter drill bits, and their methods of manufacture, are well known in the art and will not be described in further detail.

Typically, in rolling cutter drill bits, the preform cutting elements 3 provide a reaming function, whereas in fixed cutter rotary drill bits, the preform cutting elements 3 are more aggressively placed. In the context of the present invention, the exact configuration of the preform cutting elements 3 on the bit body is of no particular importance, as the preform cutting element 3 of the present invention may be applied in either application. Furthermore, any one or more of the preform cutting elements identified by numeral 3 in FIGS. 1, 2, and 10 may be interchanged with prior art cutting elements. The locations shown for the preform cutting elements 3 in FIGS. 1, 2 and 10 are provided for illustrative purposes only. They are shown only to indicate where on the rotary drill bits the preform cutting elements 3 of the present invention may be placed, and are not to be construed as limiting the invention in any manner.

Figure 3A:
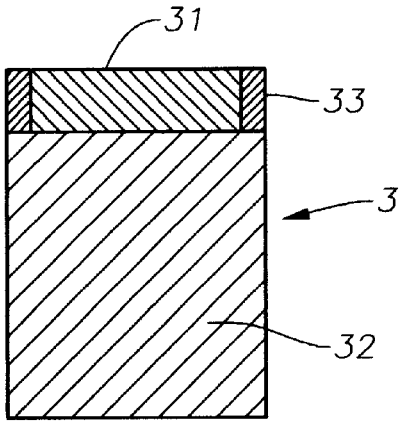
FIGS. 3A and 3B are a cross-section and a top view, respectively, of one form of preform cutting element for a drag-type drill bit, in accordance with the present invention.
Figure 3B:
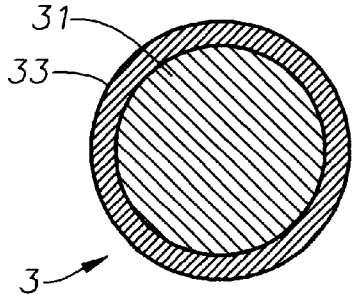

FIG. 3A and 3B shows an embodiment of a preform cutting element 3 according to the present invention which may be employed on a rotary drag-type drill bit or rolling cutter drill bit of the above-described kind, or other form of drill bit. FIG. 3A is a cross-section through the center of the cutting element. FIG. 3B shows a top view of the cutting element.

The preform cutting element 3 comprises a front facing table 31 of polycrystalline diamond bonded to a substrate 32 of cemented tungsten carbide. The edges of the facing table 31 are covered by a layer of molybdenum 33.

Figure 4A:
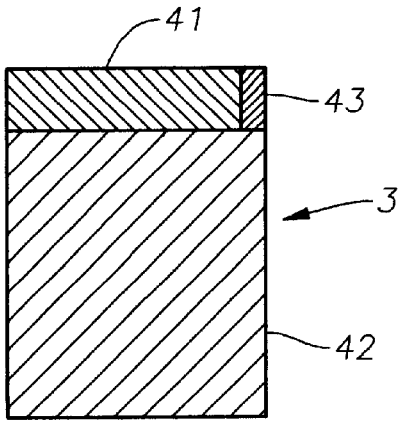
FIGS. 4–6 are similar views showing alternative forms of a preform cutting element in accordance with the invention.
Figure 4B:
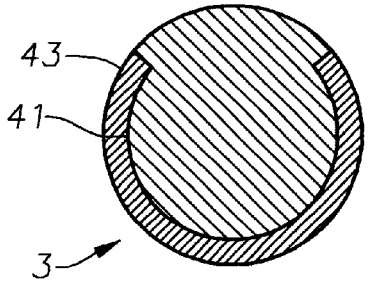
Figure 4C:
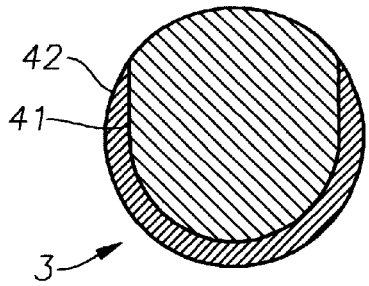

As may be seen from further examples shown in FIG. 4A to 4C, the periphery of the preform cutting element 3 can be shaped such that the facing material 41 extents to the outer diameter of the cutting element. It can be advantageous to expose the superhard material at a part of the periphery that is to first encounter the formation during a drilling operation. The soft rim 43 may have either a uniform thickness, as shown in the top view of FIG. 4B, or may have tapered corner sections 431, as shown in FIG. 4C. The latter variant reduces the sharply angled corners along the edge of the superhard table 41.

Figure 5:
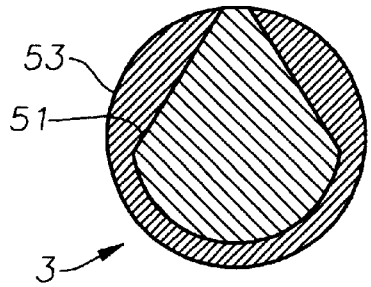

FIG. 5 shows another embodiment of the preform cutting element 3. The superhard facing table 51 is pointed having an exposed cutting edge or apex to be first directed towards the formation. The remainder of the periphery is covered by the soft metal rim 53.

Figure 6:
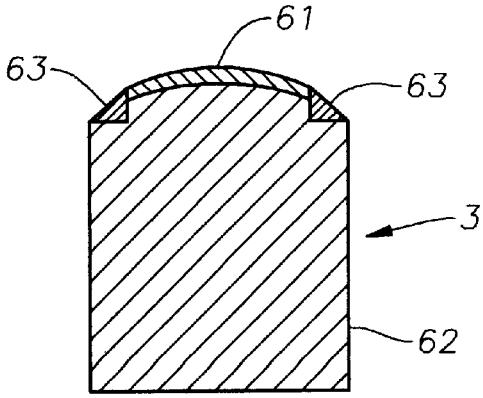

FIG. 6 shows still another embodiment of the preform cutting element 3. In this embodiment, the preform cutting element 3 has a hemispherical or dome shaped distal end. The end is capped by a layer of superhard diamond material 61. The rim material 63 resides within groove along the perimeter of the distal end of the substrate 62.

Figure 7:
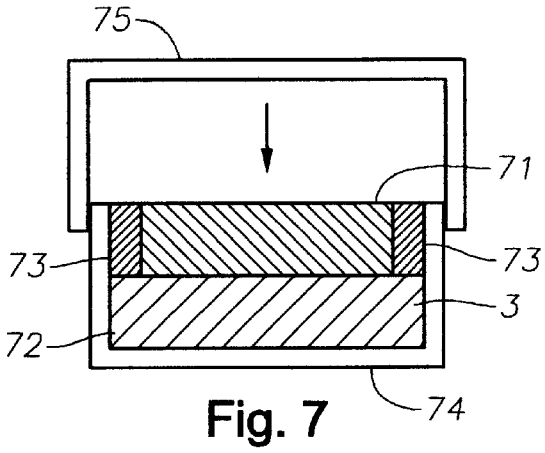
FIG. 7 illustrates an intermediate step of a method of producing preform cutting elements in accordance with the invention.

FIG. 7 shows a cross-section of an assembly that may be employed to produce preform cutting element 3. The assembly is designed to fit into the cavity of a diamond press.

The outer enclosure or can 74 of the assembly is composed of a metal such as zirconium, molybdenum, or tantalum, which is selected because of its high melting temperature and designed to protect the reaction zone from harmful impurities present in a high pressure and high temperature environment. The lid 75 is also made of a metal such as zirconium, molybdenum, or tantalum.

The diamond material 71 is preferably sized within the range of 1 to 100 microns. The substrate 72 is composed preferably of cemented tungsten carbide. Irregularities or other interface shapes may be formed on the surface of the substrate as desired and known in the art. They can be molded into the surface of an unsintered metal carbide substrate prior to sintering.

A ring-shaped element of molybdenum 73 is introduced into the metal can 74 prior to filling the remaining volume with the diamond material.

The entire cell is placed in a diamond press and subjected to pressures in excess of 40 K-bars and heated in excess of 1200 degrees Celsius for a time of about 10 to about 20 minutes. The pressure and temperature generates an intimate bond between substrate and diamond table through a process often referred to as "sintering". For the purpose of this invention it is important to note that the same type of bonding is generated at the boundary layer between the diamond material and the molybdenum ring (and between the substrate and the ring).

After pressing, the samples are lapped and ground to remove the metal can and lid 74 and 75 and to generate a cutting element with a uniform outer diameter.

Using the above method, a cutting element with a soft metallic ring around at least part of the periphery of the diamond table can be produced without an additional metal plating or deposition step.

Figure 8A:
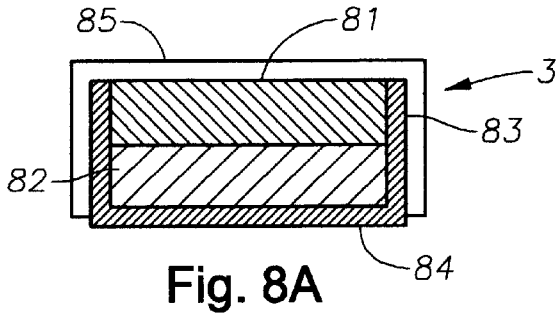
FIGS. 8A–8C illustrate intermediate steps of another method of producing preform cutting elements in accordance with the invention.
Figure 8B:
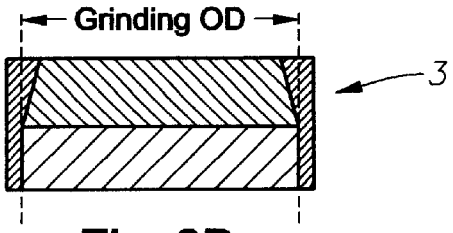
Figure 8C:
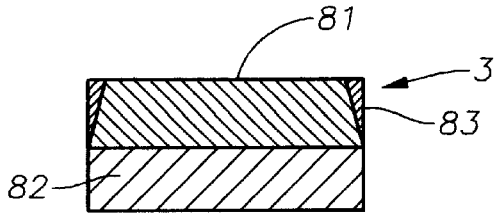

FIGS. 8A–8C illustrate a further simplified process of manufacturing the preform cutting element 3 of the present invention. Here the metal can 84 comprises the metallic material to form the rim section 83 around the superhard material 81. The samples are then processed in accordance with the steps described above. However and in contrast to the known methods, when grinding the blank to a uniform outside diameter, care is taken to not remove parts 83 of the can 84.

FIG. 8B shows the limits of the grinding process as dashed lines and FIG. 8C shows the final cutting element prior to insertion into the drill bit. The preform cutting element 3 is ground to a uniform outer diameter while the rim 83, made of residual can material, forms a sleeve of soft material enclosing the superhard facing table 81.

Finished parts are mounted on to tool shanks or drill bit bodies by well-known methods, such as brazing, LS bonding, mechanical interference fit, etc., and find use in such applications as percussive rock drilling, machining materials with interrupted cuts such as slotted shafts, or any application where high impact forces and/or thermal stress may result in delamination of the diamond layer from conventional polycrystalline diamond compacts.

Figure 9:
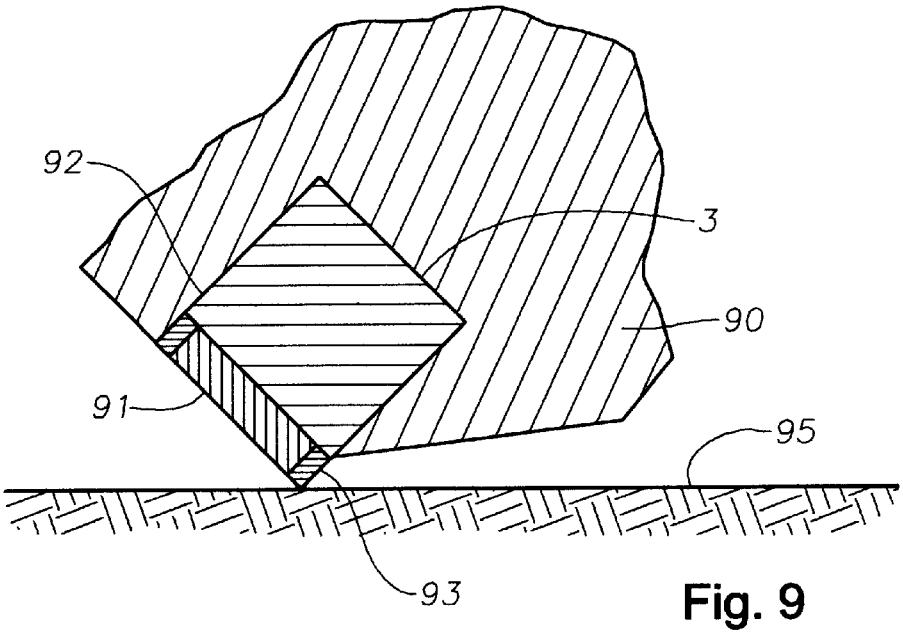
FIG. 9 shows a preform cutting element in accordance with the invention as part of a drill bit.

FIG. 9 displays a preform cutting element 3 in accordance with the present invention inserted into a drill bit. The body 90 of the drill bit is only partially shown. Inserted into the body is a preform cutter element 3 in accordance with an example of the invention. The preform cutting element 3 is shown as it engages the formation 95. The preform cutting element 3 comprises a table 91 of superhard bonded onto a substrate 92. The substrate may be extended to form a pin that is then brazed into a pocket of the body 91. In the variant of FIG. 9, the cutting edge of the facing table 91 is coated with a protective rim 93 made of soft metal. The abrasive impact of the formation is used to remove the rim 93 from the cutting edge. The remainder of the rim however provides a ductile and compliant transition zone between the superhard material and the body material of the drill bit.

Whereas the present invention has been described in particular relation to the drawings attached hereto, it should be understood that other and further modifications, apart from those shown or suggested herein, may be made within the scope and spirit of the present invention.

What is claimed is:

1. A preform cutting element, comprising a facing table of superhard material having a front face and a rear surface bonded to a front surface of a substrate which is less hard than the superhard material, the facing table having edges between the front face and the rear surface, the edges being at least partially covered with a layer made of a metallic material less hard than the superhard material but different from the substrate material, and the layer being high pressure bonded to the edges of the facing table.

2. The preform cutting element of claim 1, wherein the facing table comprises a polycrystalline diamond material.

3. The preform cutting element of claim 1, wherein the substrate is a cemented carbide of a material selected from a group consisting of periodic table groups IVB, VB, and VIB metals.

4. The preform cutting element of claim 1, wherein the layer material is softer than the substrate material.

5. The preform cutting element of claim 1, wherein the layer is an alloy of a material selected from a group consisting of molybdenum (Mo), tantalum (Ta), niobium (Nb), and titanium (Ti).

6. The preform cutting element of claim 1, wherein the layer material is a residual of a metallic enclosure enclosing the superhard material and the substrate material during the high pressure bonding, the residual not being removed prior to insertion of the cutting element into a body of a drill bit.

7. The preform cutting element of claim 1, wherein the metallic layer is high pressure bonded to the facing table and to the substrate.

8. The preform cutting element of claim 1, wherein the metallic layer forms a continuous rim around the edge of the facing table.

9. The preform cutting element of claim 1, wherein the metallic layer forms a discontinuous rim around the edge of the facing table.

10. The preform cutting element of claim 1, wherein the metallic layer forms a discontinuous rim around the edge of the facing table leaving a cutting edge of facing table without coating.

11. A rotary drill bit comprising a bit body and a plurality of preform cutting elements, said elements each having a facing table of superhard material having a front face and a rear surface bonded to a front surface of a substrate which is less hard than the superhard material, the facing table having edges between the front face and the rear surface, the edges being at least partially covered with a layer made of material less hard than the superhard material but different from the substrate material, and the layer being sintered to the edges wherein the layer material is softer than the substrate material.

12. The rotary drill bit of claim 11, wherein the facing table comprises a polycrystalline diamond material.

13. The rotary drill bit of claim 11, wherein the substrate is a cemented carbide of a material selected from a group consisting of periodic table groups IVB, VB, am VIB metals.

14. A rotary drill bit comprising a bit body and a plurality of preform cutting elements, said elements each having a facing table of superhard material having a front face and a rear surface bonded to a front surface of a substrate which is less hard than the superhard material, the facing table having edges between the front face and the rear surface, the edges being at least partially covered with a layer made of material less hard than the superhard material but different from the substrate material, and the layer being sintered to the edges wherein the layer is an alloy of a material selected from a group consisting of molybdenum (Mo), tantalum (Ta), niobium (Nb), and titanium (Ti).

15. The rotary drill bit of claim 14, wherein the layer is high pressure bonded to the facing table and to the substrate.

16. The rotary drill bit of claim 14, wherein the layer forms a continuous rim around the edge of the facing table.

17. The rotary drill bit of claim 14, wherein the layer forms a discontinuous rim around the edge of the facing table.

18. The rotary drill bit of claim 17, wherein the layer forms a discontinuous rim around the edge of the facing table, leaving a cutting edge of the facing table uncovered by the layer.

19. A rotary drill bit comprising a bit body and a plurality of preform cutting elements, said elements each having a facing table of superhard material having a front face and a rear surface bonded to a front surface of a substrate which is less hard than the superhard material, the facing table having edges between the front face and the rear surface, the edges being at least partially covered with a layer made of material less hard than the superhard material but different from the substrate material, and the layer being sintered to the edges wherein the layer material is a residual of a metallic enclosure enclosing the superhard material and the substrate material during the high pressure bonding, the residual not being removed prior to insertion of the cutting element into a body of a drill bit.

20. The rotary drill bit of claim 19, wherein the layer is high pressure bonded to the facing table and to the substrate.

21. The rotary drill bit of claim 19, wherein the layer forms a continuous rim around the edge of the facing table.

22. The rotary drill bit of claim 19, wherein the layer forms a discontinuous rim around the edge of the facing table.

23. The rotary drill bit of claim 22, wherein the layer forms a discontinuous rim around the edge of the facing table, leaving a cutting edge of the facing table uncovered by the layer.

* * * * *